US008157477B2

(12) United States Patent
Horan et al.

(10) Patent No.: US 8,157,477 B2
(45) Date of Patent: Apr. 17, 2012

(54) TRENCHING AND DRAIN INSTALLATION SYSTEM AND METHOD

(75) Inventors: Jeff Horan, Mt. Vernon, WA (US); Matt Anderson, Oak Harbor, WA (US)

(73) Assignee: Aurora Sun Alliance Corp., Mount Vernon, WA (US)

( * ) Notice: Subject to any disclaimer, the term of this patent is extended or adjusted under 35 U.S.C. 154(b) by 283 days.

(21) Appl. No.: 12/425,301

(22) Filed: Apr. 16, 2009

(65) Prior Publication Data

US 2009/0263195 A1 Oct. 22, 2009

Related U.S. Application Data

(60) Provisional application No. 61/045,594, filed on Apr. 16, 2008.

(51) Int. Cl.
*F16L 1/026* (2006.01)
*E02F 3/18* (2006.01)

(52) U.S. Cl. ..... 405/183; 405/179; 37/97; 37/190

(58) Field of Classification Search ..... 405/154.1, 405/174, 179, 180–183; 37/91, 94, 95, 97, 37/189, 190
See application file for complete search history.

(56) References Cited

U.S. PATENT DOCUMENTS 1,470,028 A * 10/1923 Parker ..... 37/96
3,203,188 A 8/1965 Evans
3,332,249 A 7/1967 Idoine
3,521,456 A * 7/1970 Blackwell ..... 405/157
3,905,200 A 9/1975 Ylinen
4,116,014 A * 9/1978 Satterwhite ..... 405/179
4,397,585 A 8/1983 Fouss et al.
4,563,826 A * 1/1986 Whitaker, Jr. ..... 37/97
4,720,929 A * 1/1988 Umberson ..... 37/91
4,794,709 A * 1/1989 Rivard ..... 37/94
4,812,078 A 3/1989 Rivard
4,825,569 A 5/1989 Porter
5,174,685 A 12/1992 Buchanan
5,381,616 A * 1/1995 Disney ..... 37/94
5,575,538 A * 11/1996 Gilbert et al. ..... 299/39.2
5,743,675 A 4/1998 Fluharty et al.
5,913,638 A * 6/1999 Lansdale ..... 405/179
6,249,983 B1 6/2001 Wright et al.
6,249,993 B1 6/2001 Armstrong et al.
6,318,006 B1 * 11/2001 Hall ..... 37/367
6,460,640 B1 10/2002 Keagle et al.
6,478,508 B1 11/2002 Magnani et al.
6,547,337 B2 * 4/2003 Welch, Jr. ..... 299/39.3
6,622,403 B2 9/2003 Munie
6,637,978 B1 * 10/2003 Genta ..... 405/174
6,708,430 B2 3/2004 Azure et al.
6,830,412 B2 * 12/2004 Perez ..... 405/180
6,854,931 B1 2/2005 Lopata
7,096,609 B2 8/2006 Bainter
2009/0007460 A1 * 1/2009 Greenlee et al. ..... 37/94

* cited by examiner

*Primary Examiner* — Tara Mayo-Pinnock
(74) *Attorney, Agent, or Firm* — Matthew Jellett

(57) ABSTRACT

A system for trench and drain installation. The system utilizes an implement driven trenching assembly and a backfill pipe installation assembly. The implement driven trenching assembly digs a trench utilizing a circular trenching blade which is hydraulically operated and is mounted onto a front loader plate. The backfill pipe installation assembly uses a backfill hopper to simultaneously install drainage pipe above the trench floor and envelop the drainage pipe in backfill material to maintain the drainage pipe at a constant height above the trench floor.

33 Claims, 9 Drawing Sheets

TRENCHING AND DRAIN INSTALLATION SYSTEM AND METHOD

RELATED APPLICATIONS

This application claims priority benefit of U.S. Ser. No. 61/045,594 filed Apr. 16, 2008.

BACKGROUND

U.S. Pat. No. 3,203,188 discloses a method and apparatus for preparing a trench for a subsurface conduit line and for laying such a line. A conventional trench digging machine which includes a vertically adjustable frame supporting a power driven digging wheel with digging buckets mounted to the periphery of the wheel allows for digging trenches at different depths.

A chain and sprocket drive is utilized to drive the wheel. The earth is treated to separate the fine particles from the larger particles through the use of mesh. The screen or mesh is inclined so the rocks will gravitate to the shoot. After the particles are separated, the fine particles of the earth are deposited on the bottom of the trench to act as a cushion pad on which the conduit can be laid. A conveyor belt transfers the fine particles to the bottom of the trench and a leveling shoe adjusts the mound to give the pad a depth which may be on the order of six or more inches.

U.S. Pat. No. 3,332,249 discloses a trench digging and refilling apparatus. The digger has a vertically oriented trench digging unit which is attached to a tractor. The digging unit continuously elevates dirt onto a circular conveyor which conveys the dirt and discharges it rearwardly into the trench after a continuously fed cable is placed in the trench between the locations of digging and refilling.

U.S. Pat. No. 3,905,200 discloses a cable laying attachment for vehicles. The attachment has an elongated beam member to connect to the front end of the vehicle. A support arm is arranged as a tubular structure which can telescope. A plow blade carrier, a plow and a cable shoe are carried at the rear end of the beam member. During the course of plowing, the plow blade is positioned in a straight longitudinal position relative to the path of movement of the tractor. The cable is fed through the shoe as it is supplied from a drum. The cable is fed over the pulley and into a guide shoot in the shoe. The vertical positioning of the beam member is accomplished by the support arm through the medium of cylinder members. The depth of the plow is accomplished through suitable actuation of the cylinder. As the plow travels through the ground, the cable is laid immediately afterwards in its desired vertical position.

U.S. Pat. No. 5,174,685 discloses a flexible pipe laying and covering apparatus. This apparatus lays the flexible pipe in a trench embedding it within a bed of gravel in a single operation. A gravel hopper, a guide sleeve, and a skid or sled allows the apparatus to be dragged through the trench, lay the pipe, and fill around the pipe with gravel. The apparatus permits pipe to be laid without requiring personnel to be located within the trench thus avoiding the increased costs required by OSHA regulations for tapering the trench walls or bracing them to avoid cave-in.

U.S. Pat. No. 4,397,585 discloses an apparatus for inserting foldable conduit below ground. A plow forms a cavity in the ground for receiving conduit and the conduit is conveyed through a feeder from a conduit reel of some sort. As the conduit passes through the feeder the conduit is unfolded. Soil lifted by the plow falls around the unfolded conduit constraining it to its unfolded configuration.

U.S. Pat. No. 4,812,078 discloses a mechanized unit for digging a trench and laying elongated objects, the mechanized unit has a motorized vehicle, a digging wheel connected to the rear of the vehicle, a conduit device for holding the coiling conduit at the front of the vehicle, a guide device for laying the conduit in the trench, a soil shoot of some sort for laying the conduit in the bottom of the trench and covering the conduit with the soil.

U.S. Pat. No. 4,825,569 discloses a trench digging, cable laying and trench filling apparatus, the apparatus uses a safety shield to direct the previously excavated dirt back into the trench, the apparatus has a cable laying device which lays the cable in the trench before refilling the trench with dirt, a spool of cable supported on a rod and the cable is fed into the open trench ahead of the loose dirt which is then covered by the loose dirt.

U.S. Pat. No. 5,743,675 discloses an underground cable anode installment system. The system has a plow which creates a tunnel, conduit is delivered into the tunnel, a shoot feeds the conduit into the tunnel, also a coke breeze can be delivered to the tunnel by passing it over the nonmetallic inner surface of the shoot to provide for horizontal encasement of the anode cable.

U.S. Pat. No. 5,913,638 discloses a sand channel trenching and pipe laying apparatus. The apparatus is connected to a motor driven vehicle which has an elongated frame with a turf cutting assembly which includes a couple of vertical cutting blades for removing a strip of turf. A pipe dispenser for laying in position the pipe in the channel is secured to the sub frame mounted on the rearward portion of the frame. A sand funnel is linked to a sand hopper and mounted on the same sub frame as the pipe layer. Sand is forced through the shoot into the trench. The sand covers the pipe and fills the trench.

U.S. Pat. No. 6,478,508 discloses an apparatus for laying underground electric cables, where a vehicle is towed along a trench and carries a van and a depositing unit which forms the base layer of an inner material for heat dissipation at the bottom of the trench upon which high-voltage lines are carried. The second van carries a second depositing unit which forms the cover of the inert material above the cable and the first layer.

U.S. Pat. No. 6,622,403 discloses a backfill and grading apparatus. The apparatus deposits material within the trench. The apparatus has a hopper and an elongated shoot which extends down from the hopper into the trench. The apparatus has a gate between the hopper and the shoot for controlling material flow out of the hopper, through the shoot and into the trench. The apparatus is mounted on the back of a trailer with a variably positionable mount and includes a laser guided control system to maintain the deposit material at the predetermined grade.

Referring to Col. 3 around line 33, in an exemplary embodiment, the apparatus is coupled to a tractor by a hydraulic mount that variably positions the apparatus up and down along a substantially vertical axis with respect to the tractor. The hydraulic mount has a control element that controls the vertical position of the apparatus response to input signals from the operator. Thus the position of the apparatus can be made subject to automatic control of the operation of control element in connection with or as part of an automatic control system. Referring to Col. 4 at line 27, an operator digs a trench and bedding is installed in the trench. Pipe is then installed in the trench and placed on the bedding and then covered to the predetermined grade with the appropriate material.

U.S. Pat. No. 6,854,931 discloses an apparatus for establishing adjustable depth bed soil in trenches for utility lines and encasing the lines. The unit places a predetermined and adjustable depth of selected bedding material on the bottom of the trench in the ground, then places on the bed a continuous length of utility line having a predetermined spatial relationship with each other and then encases utilities with additional select material to a predetermined and adjustable depth in a continuous operation. A single hopper is used to form the bed for both utility lines. An adjustable height blade is provided which both sets the blade height and also smooths the bed surface for each utility line.

Trenchers

U.S. Pat. No. 6,708,430 discloses a trencher for digging trenches, referring to the summary of the invention section in column one around line 52, "one aspect of this invention relates to a trencher for digging trenches. The trencher comprises a trencher frame. A chain bar is secured at one end to the trencher frame to extend outwardly from the trencher frame in a cantilever manner. An endless chain having digging teeth is provided with the endless chain being carried on the chain bar. The chain bar comprises a base member secured to the trencher frame which base member carries a stub having a longitudinal axis, an elongated boom having a socket at one end which socket is slipped over the stub of the base member, a slot in the stub with the slot extending parallel to the longitudinal axis of the stub, and at least one bolt passing through the boom and the slot to secure the boom to the stub."

U.S. Pat. No. 7,096,609 discloses a trencher unit, referring to the brief description of the invention in column one around line 43, "The trencher unit of the present invention is a unit that can be mounted to a standard attachment plate of a loader such as a typical skid steer loader. The trencher unit relies on the auxiliary hydraulic power of a loader and can be operated in an upright orientation to dig curved trench sections. The trencher unit includes a support frame having an attachment fitting at its proximate end for mounting to the attachment plate of a loader. A chain drive sprocket is rotatably mounted to the support frame near the proximate end of the support frame. An idler wheel is mounted to the support frame at the distal end of the support frame. The chain drive sprocket and the idler wheel carry an endless digging chain which presents a series of digging teeth. A hydraulic chain drive motor for driving the chain drive sprocket and the digging chain is mounted to the support frame. Auxiliary hydraulic lines which communicate with the loader hydraulic system supply the hydraulic chain drive motor with pressurized hydraulic fluid. An auger assembly situated on the support frame between the drive sprocket and the idler wheel includes augers for pushing dirt away from the digging chain."

U.S. Pat. No. 6,249,983 discloses a trencher assembly utilizing a direct drive motor, referring to the disclosure of the invention section in column 2 around line 1, "In one aspect of the present invention, a trencher assembly comprises a frame. A boom arm is connected on the frame. A motor is connected on the frame and has a rotatable shaft. A sprocket is connected on the shaft of the motor. The sprocket is directly driven by the motor through the rotation of the shaft. A digging chain is connected between the boom arm and the sprocket and is driven by the rotation of the sprocket. An auger assembly is connected to the sprocket for rotation therewith in unison with the digging chain."

DESCRIPTION OF THE EMBODIMENTS

Generally speaking, this is a trencher assembly which includes a trencher and loader, the loader enables the trencher assembly 10 to be operated along various types of ground engaging trench digging locations which may require the laying of various types of utility pipe. For example, the utility pipe may be a drainage pipe with perforated holes requiring the trench itself to be dug at a constant grade, and width regardless of the upper surface grade variations. Furthermore, many times the grade itself is in a pre-conditioned state, for example sports fields, golf courses, parks, and other landscaped locations which require low pressure distribution at construction for example a minimum of 15 psi of load placed on the surrounding ground by the equipment providing the trench may be a tolerable limit to not permanently degrade the surface.

Various limitations may be made on the trench itself. For example: a width range of 3 inches to 12 inches corresponding to a depth range which varies depending upon the non-pervious soil locations. The depth ranges from approximately 6 inches to proximately 60 inches or 80 inches or more depending on the upper surface grade variations and the desired flow.

Figure 1:
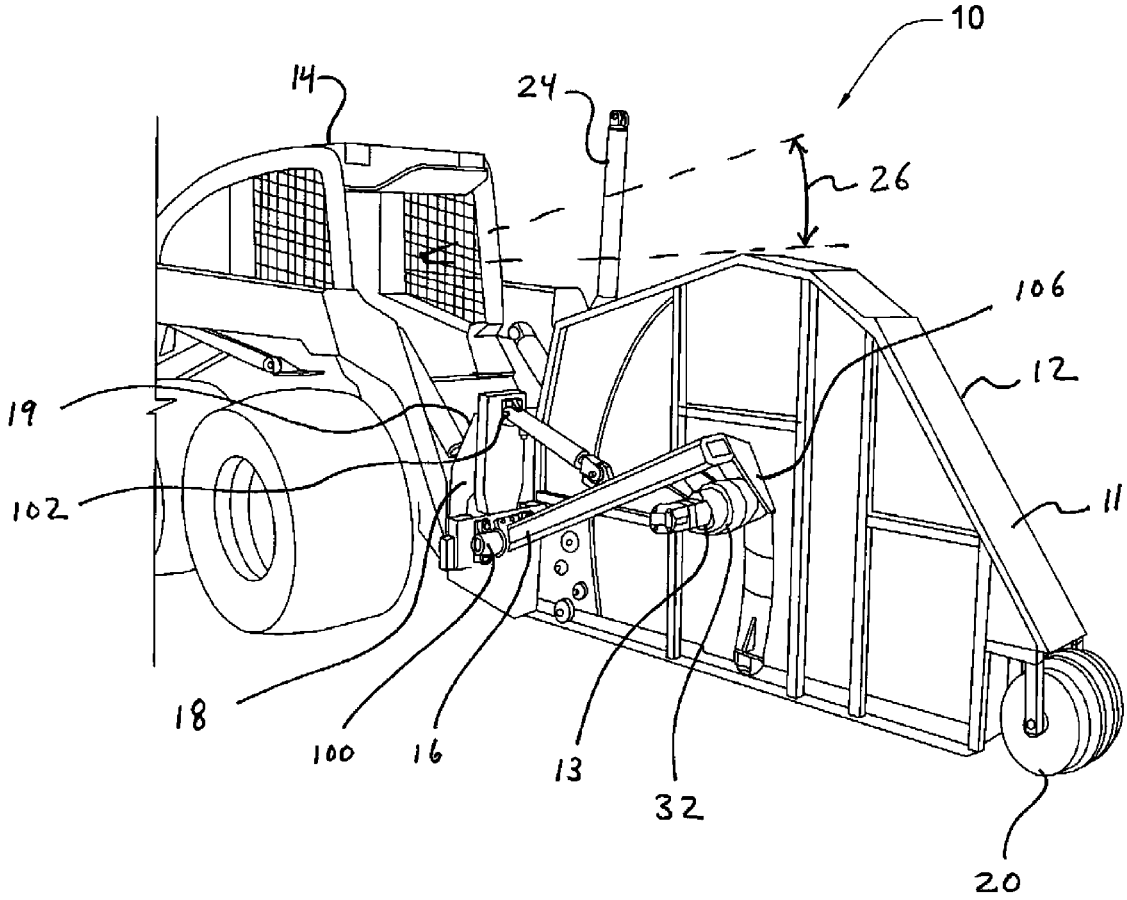
FIG. 1 is a perspective view of the trenching assembly.

Referring to FIG. 1, the trencher assembly 10 utilizes two components, a trencher 12 and a skid steer 14. In lieu of a skid steer, an excavator, a front loader, a dozer or other type of construction equipment which has hydraulically enabled controls can be utilized. Additional components can be added or taken away depending on the desired function of the trencher assembly. For example, a pipe-laying hopper can be provided at the front or rear portions of the skid steer, also a spoils hopper may be provided latterly adjacent to the spoils exit location, the spoils exit location to be discussed further below. The skid steer 14 may also be a track driven skid steer, a wheel driven skid steer, a caterpillar, or other type of construction equipment which enables the construction crew to hoist the trencher 12.

Figure 2:
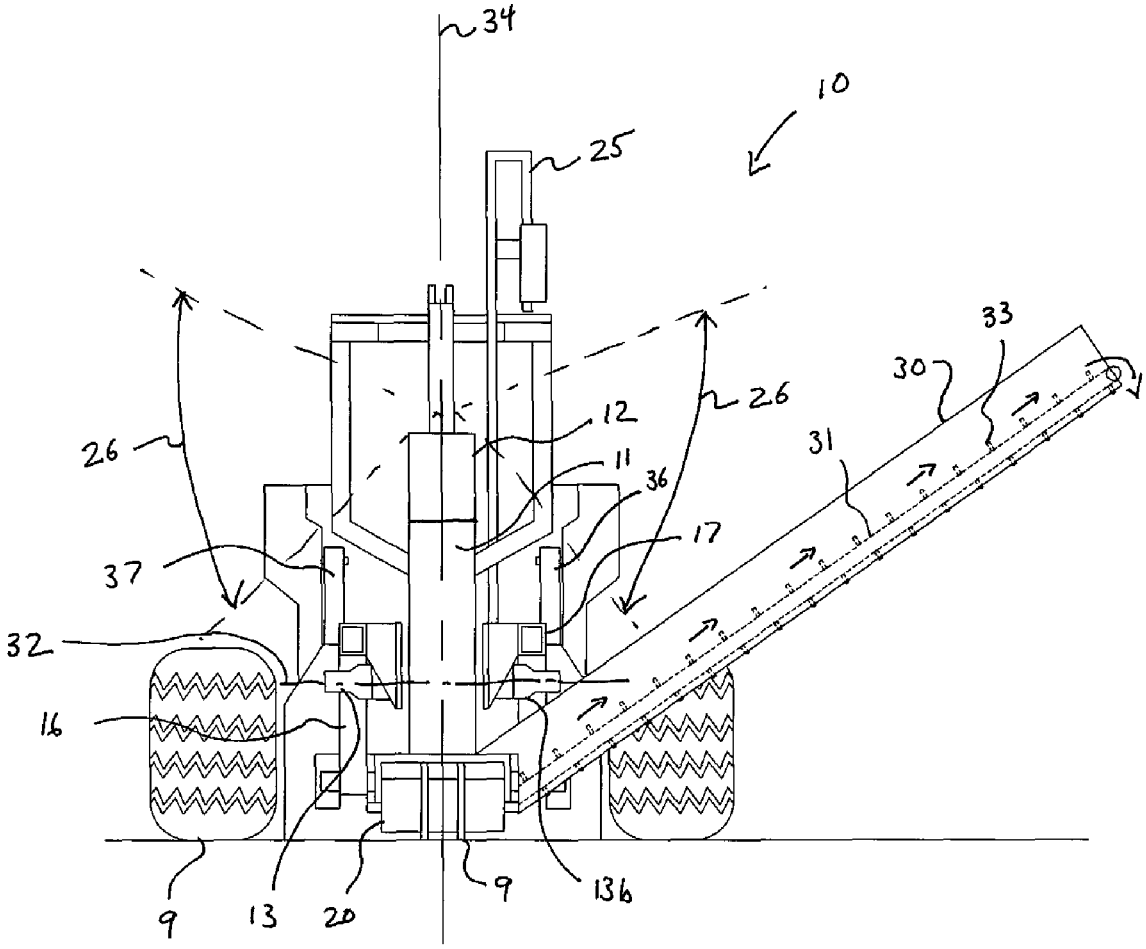
FIG. 2 as a front elevation view of the trenching assembly.

The trencher is configured with a front profile width which enables the operator to have various sightlines 26 above or laterally from side to side of the trencher 12 for safety as well as alignment requirements. In the present embodiment as seen in FIG. 2, the trencher is centrally aligned along the vertical axis 34 bisecting the skid steer 14. In alternative embodiments, the trencher 12 may be arranged laterally on one side or another of the vertical axis 34 providing a clear sight distance if the load parameters of the ground engaging surface locations 9 meet the desired trenching specifications for service load.

In this particular embodiment, the trencher 12 is connected to the front loader plate 19 of the skid steer 14 through the use of a removable front loader plate attachment 18. In this particular embodiment, along the forward surface of the removable front loader plate 18, is attached an articulating member 16 having a pivot couple 100 connected to the removable front loader plate 18 and the articulating member 16. The articulating member 16 is pivitably attached to an articulating member hydraulic 22. The articulating member hydraulic 22 is located above the articulating member 16 and attached to the top couple 102 and a member midpoint couple 104. This angularly aligned hydraulic 22 provides for the leverage arm to position the trencher 12 in various trench engaging arrangements such as a non-ground engaging position, a ground engaging position, and a trench engaging position. Furthermore, during the non-ground engaging position, when the trencher is placed in position within the trenching position/location on the ground surface, the weight of the trencher 12 applies a greater specified load to the skid steer wheels so additional load pressure distribution may be required through the use of larger wheel's or a track system etc. . . .

A detailed discussion of the various components of the trencher assembly 10 will now be provided. Still referring to FIG. 1, the articulating member 16 extends radially from the pivot couple 100 and supports a hydraulic motor 13. The entire trencher assembly 10 is driven by the hydraulic capabilities of the skid steer 14, or in an alternative embodiment, the hydraulics may be provided on the trencher 12 itself. In a further embodiment, a mechanized chain driven trencher 12 may be utilized having the same centrally aligned axle 32 with a motor located on the trencher, the skid steer, or combinations of the above. The combination may include a hydraulically driven motor located at another location on the trencher and providing additional work on a chain driven system to drive a sprocket connected to the trench blade axle 31. The trencher has a trencher shield envelope or trencher hood 11 which provides for encasement and/or containment of the ground soils as the trencher 12 is operating. Furthermore, an optional front wheel guide 20 is provided to assist in relief of load pressure and guide the trencher on its predetermined course. To make room for the hydraulic motor 13, the articulating member 16 is attached to a gusset plate 106 which accesses the support for the hydraulic motor axle 31 and the hydraulic motor 13. The axle extends through the trencher 12 to an equal but opposite second articulating member 17 and depending on the power requirements for driving the trenching blade 58 as seen in FIG. 3, the second articulating member 17 may optionally have a second hydraulic motor 13*b*.

Referring to FIG. 2, the trencher assembly 10 is shown with the spoils remover 30 which in this embodiment is a hydraulically driven conveyor. The conveyor 30 receives the built-up soils within the fore portion of the trencher 12 and grabs the spoils as it falls onto the trencher conveyor belt. The spoils utilizing the spoils remover 30 enables the trencher assembly 10 to provide a clean finished trench. Other embodiments of the spoils remover 30 are readily conceived. They may include some form of manual spoils removing from a catch basin or bucket arranged somewhere along the trencher 12, a chute which extends from the vertical portion of the trencher forward, rearward, laterally, or anywhere in between to provide exiting of the spoils from the interior portion of the trencher 12 or in other words the trencher envelope 11.

While the present trencher spoils remover 30 is located at the fore portion of the trencher, the conveyor 30 may be arranged at the rear portion of the trencher to receive soils as they pass behind the trencher system.

Figure 3:
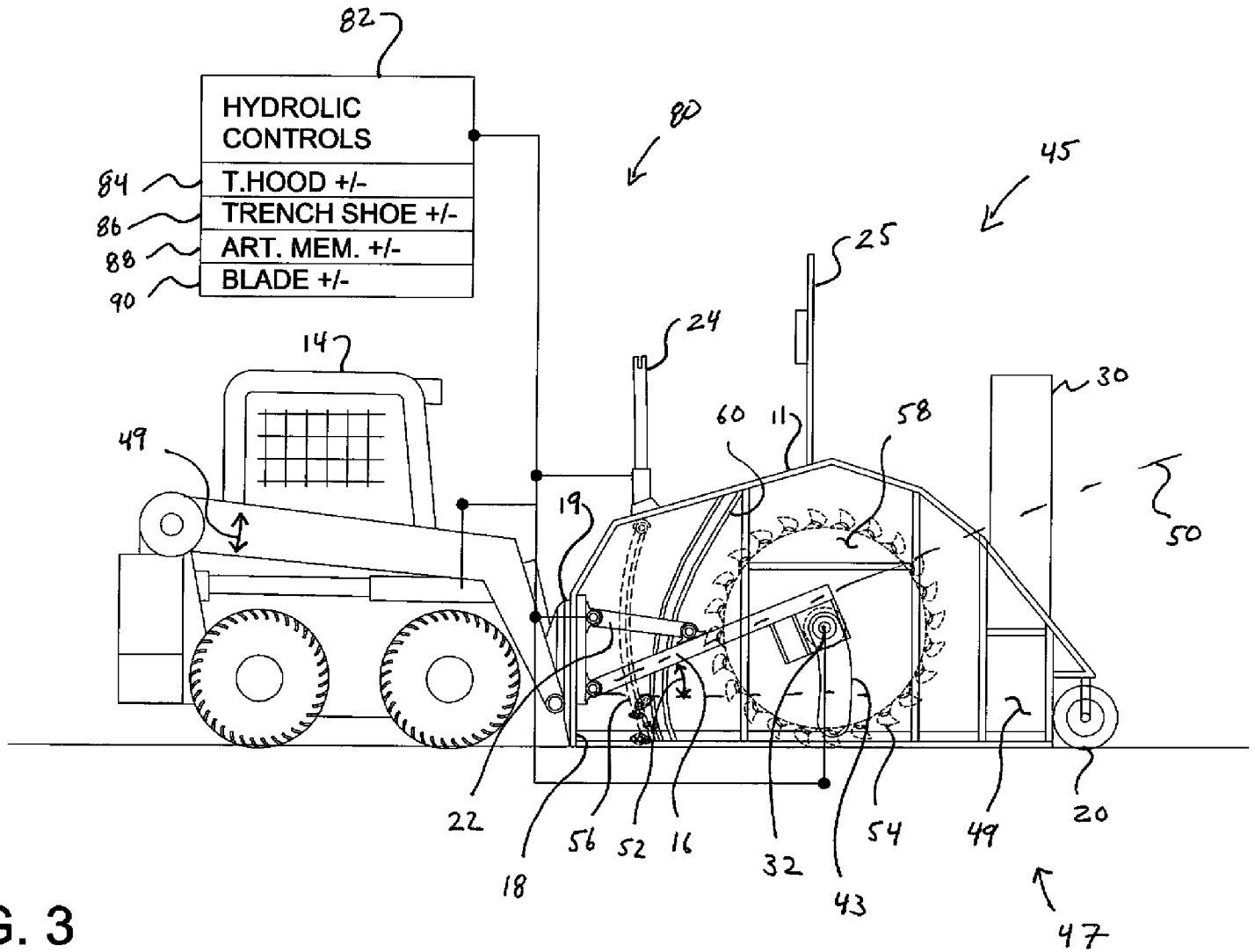
FIG. 3 is a side elevation view of the trenching assembly in a non-trench engaging position.
Figure 4:
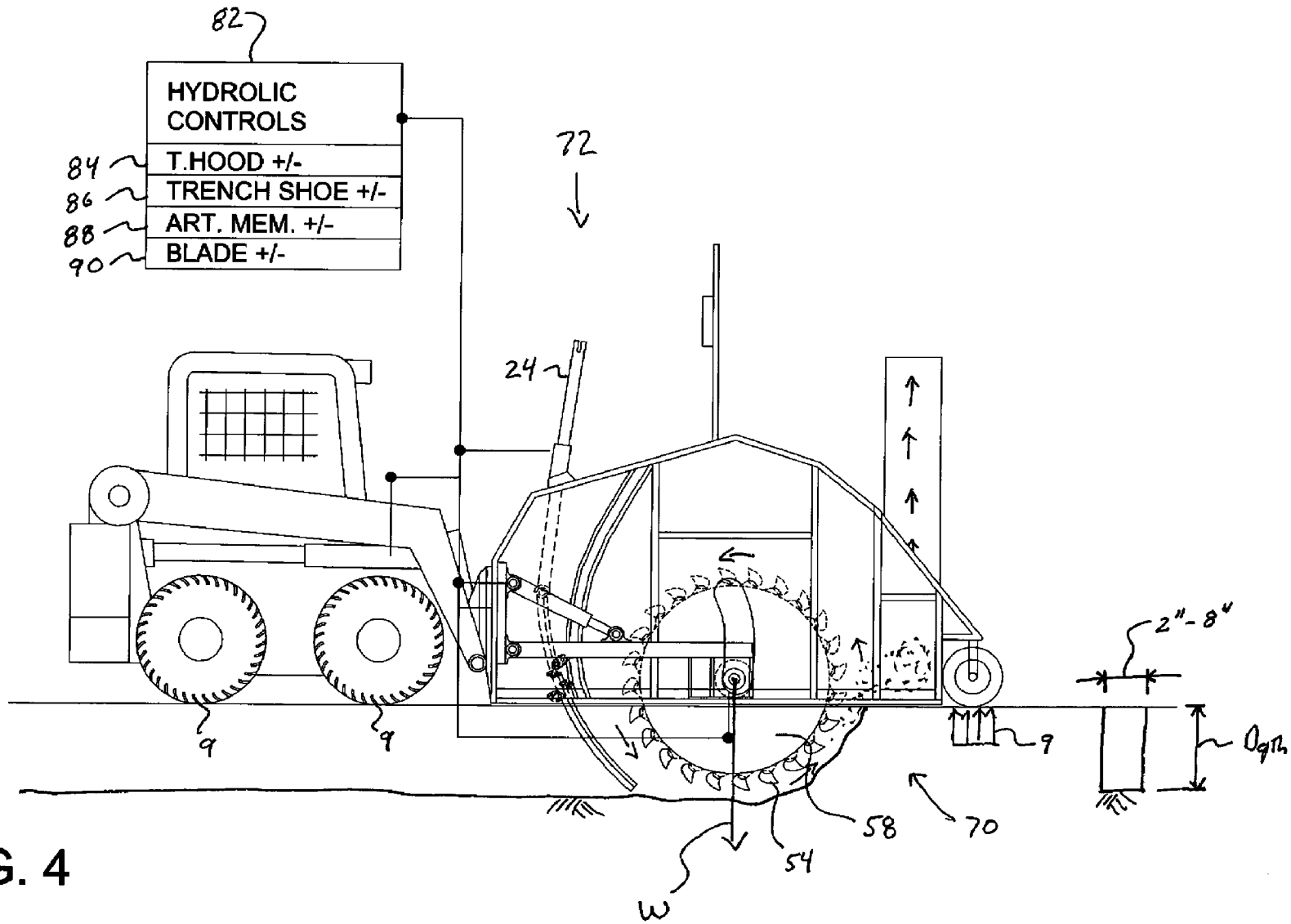
FIG. 4 is a side elevation view of the trenching assembly in a trench engaging position.

Referring to FIGS. 3 and 4, a discussion of the operation 70 of the trenching blade with a detailed description of the elements of the blade will now be provided. As previously discussed, the front loader or skid steer 14 will enter onto the job site or the grade 36, and the trencher 12 will be completely raised up from the ground engaging location providing mobility to the trenching location. Once proper alignment is made along the vertical axis 34 with the trench profile, the operator will use the hydraulic controls 82 located on the skid steer to move the trencher into a ground engaging location 45 by actuating the trench controller 84. In this operation the trenching blade 58 is raised up and does not engage the ground. The operator engages the trench hood controller 84 which operates the hydraulic motor, to lower the front loader arm 49 of the skid steer 14 and also to operate the front loader plate 19 lowering the trenching hood which contains the trenching blade onto the ground engaging position 45.

As mentioned previously, the trenching blade 58 can move about a partial radial axis along the radial blade sleeve 43 which enables circumferential travel of the trenching blade 58 and its centrally aligned blade axle 32 (FIG. 2) to engage and disengage the ground engaging location.

Prior to digging, the trenching blade 58 is raised up in its non-engaging position 58. The operator will first actuate the blade controller 90 in order to start the hydraulic motors 13 and begin to rotate the trenching blade 58 about the axle 31. In doing so, the radially aligned circumferentially spaced trench blade tools 54 rotate about the circumference of the trenching blade 58.

Once the proper revolutions per minute or RPM's have been reached, the operator can then lower the trenching blade 58 onto the ground engaging surface and began digging the trench. In order to do so, the operator engages the articulating member control 88 and begins to lower the articulating member 16 and the attached trenching blade 58 to the point where the trench blade tools 54 begin to dig into the ground engaging location. Because of the weight of the trenching blade itself, which in one embodiment is 2,500 pounds, the trenching blade will dig into the low weight bearing soil, which may be as little as 15 pounds per square inch load bearing capacity, and move the earth towards the debris collection location 49.

In profile, the radially aligned circumferentially spaced trench blade tools 54 are angled off-center from the vertical axis 34 to provide for digging at a depth and width of the trench. The trenching tools 54 are optionally adjustable to different positions to provide varying degrees of trench digging.

Figure 6:
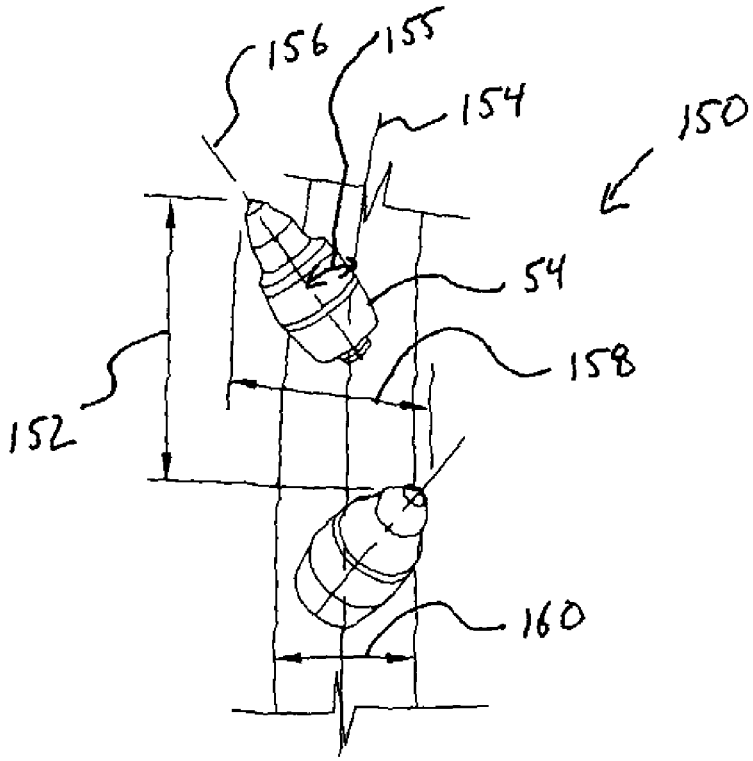
FIG. 6 is a detail perspective view of the trenching tool arrangement.
Figure 7:
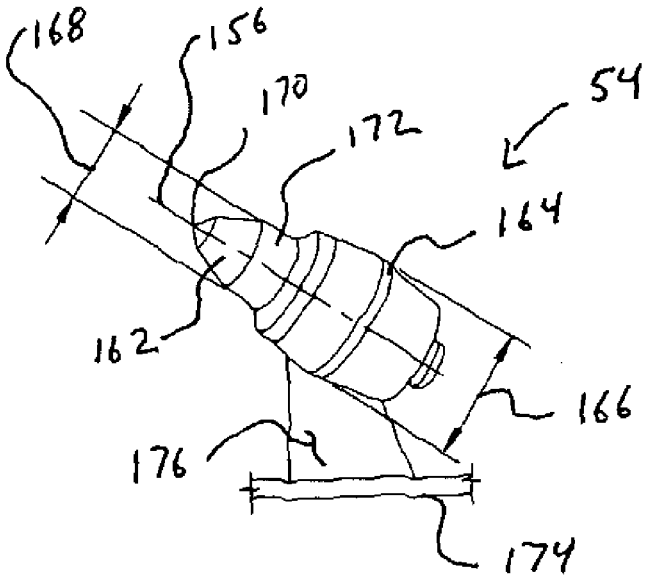
FIG. 7 is a detail profile view of a trenching tool.

Referring to FIGS. 6 and 7, a detailed discussion of the spacing and construction of the trench blade tools will now be provided. In one embodiment, the trenching tool arrangements 150 as seen in FIG. 6 provide for the trenching blade to trench at varying digging widths 158 and also provide for varying trench blade tool spacing 152. For example, the specifications of the trench may require that the digging width 158 correspond to a 6" wide trench which will enable a 4" solid collection manifold to be seated approximately ½" above the base of the trench. In other embodiments, the tools 54 may need to be orientated along their tool accesses 156 to narrow the digging width 158 to approximately 5" so that the trenching blade can dig a 5" wide trench which will enable a 2" perforated pipe to be installed approximately 2" above the floor of the trench.

The trenching tools 54 are orientated off-center from the centerline of the trenching blade 154 so that the tool axis 156 is vectored away from the centerline of the trenching blade at a tool axis angle 155. The trenching blade width 160 may be as narrow as 1.5" or as wide as 6" depending upon the required digging specifications.

The trenching tool 54 seen in FIG. 7 is constructed of a solid steel body and has a tool body 164 which in one arrangement is a cylindrical main body, the tool body has a tool body diameter 166 of approximately 1½" to approximately 4" in diameter depending upon the desired specifications. At the fore end of the tool 54 is a tool head 162 which has a tool head main body 172 which is a cylindrical arrangement and has a smaller diameter than the tool body 164. The tool head main body 172 transitions to tool head point 170 where the tool head point is conically shaped. The tool head diameter 168 ranges from approximately ½" to approximately 2" in diameter depending upon the construction specifications.

The tool 54 is rigidly connected to the tool blade outer wall 174 by a tool base 176 which is a rigid steel plate approximately ¼" to ½" in width and is fully welded all round top and bottom to both the tool main body 164 and the trenching blade outer wall 174.

The current embodiment provides for a solid metal trench blade 58 with a diameter which may range from approximately 24 inches to approximately 90 inches or more in diameter depending upon the desired trench depth, weight of the trenching blade 58, and pressure of use of the hydraulic arms 22 and 23 to drive the trench into the ground engaging location. The trench blade 58 may be, in alternative embodiments, elliptical in profile, rectilinear in profile, or any other nonsymmetrical profile such as an off centered pie shaped blade or other configurations depending upon desired use and digging procedures. The sizes of the trenching blade correspond proportionally to the weights of the blade. For example, the trenching blade 58 may have a weight range of approximately 250 pounds to approximately 4,750 pounds with the present embodiment being around 2,000 pounds to 2,500 pounds. As mentioned, the weight of the blade in the trencher may be a function of the skid steer ground engaging wheels or track which provides proper load bearing pressure pounds per square inch to meet the preconditioned turf specifications.

The non-trench engaging position 45 or in other words the ground engaging position 45 of the trench hood, includes the radially aligned articulating member 16 which is aligned along the radial axis 50. This alignment enables the operator to move the trenching blade as previously discussed, into the trench engaging position 72 as seen in FIG. 4.

For example, the land owner's specifications may require only a weight distribution of 15 pounds per square inch due to the finished grade being a working golf course, working athletic field, or other unmissable field with low soil weight capacity. To determine the proper grade elevation, the depth gauge 25 may be connected to a GPS or laser level or other survey equipment, and enable the operator to adjust the depth of the trenching blade 58 for proper slope orientation.

To catch the ground spoils since the ground is dug by the trencher, the trencher blade tools 54 kicks the spoils forward which are deposited into a debris collection location 49 located at the fore end of the trencher unit 12. The trencher blade tools continue rotating and some of the spoils are carried through the shield envelope but a majority of the spoils are collected at the debris collection location 49. The spoils are then deposited onto the conveyor belt 31 of the spoils conveyor 30 by being lifted out of the debris collection location 49 and onto the conveyor belt 31 or in other words, a never ending lift, through the use of conveyor shelves 33 which protrude into the debris collection location space 49 to grab the debris as it is deposited into the collection location.

To make the trench smooth and free of debris, a trench shoe 56 is provided to scrape the bottom of the trench. In this particular embodiment, the trench shoe 56 is aligned along an elliptical curve and is threaded between a plurality of rotation joints which enable the hydraulically driven shoe 56 to be actuated from a ground engaging position to a non-ground engaging position through the use of a shoe hydraulic 24. Once the spoils are cleared from the trench digging location, the spoils rotate to the debris collection location 49 for removal by the spoils conveyor 30. As stated above, the debris is then deposited from the spoils conveyor 30 onto a collection truck or spoiler hopper.

Figure 8:
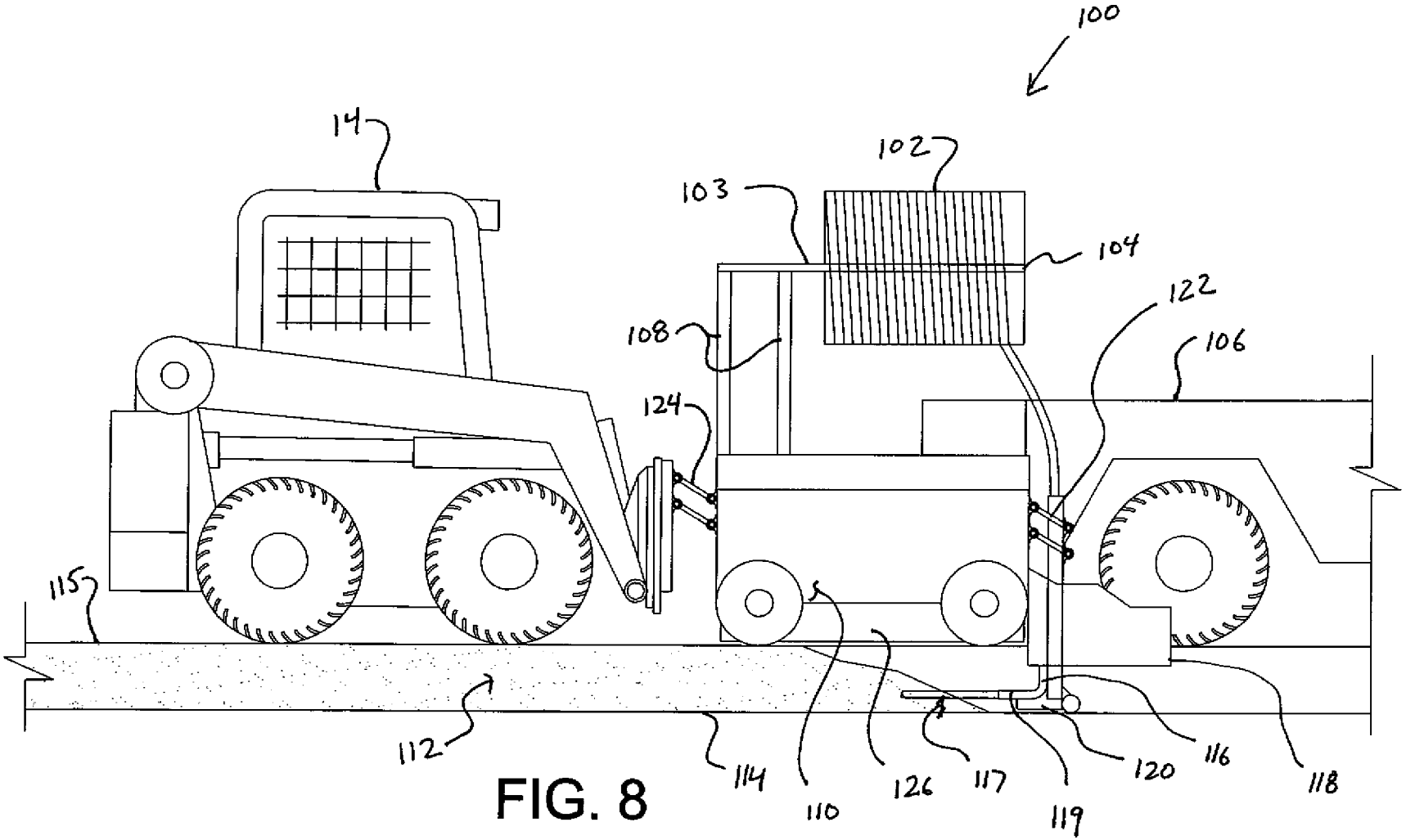
FIG. 8 is a side elevational view of the backfill pipe installation assembly.
Figure 9A:
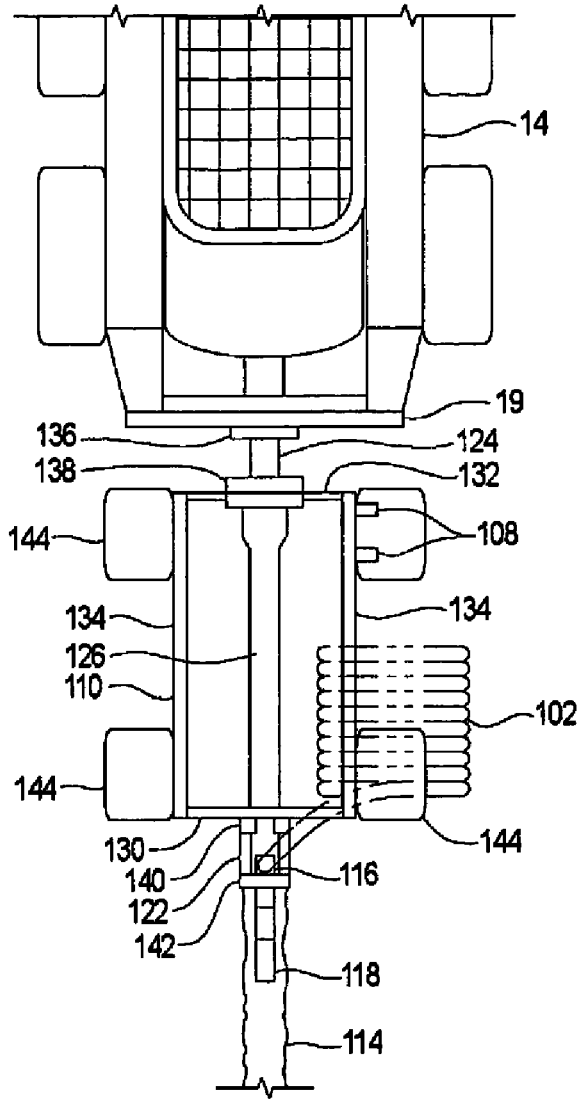
FIG. 9A is a top plan view of the backfill pipe installation assembly.
Figure 9B:
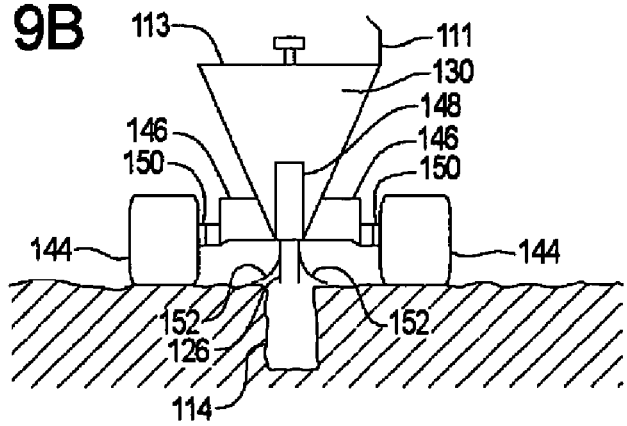
FIG. 9B is a front elevational view of the backfill pipe installation assembly.
Figure 10:
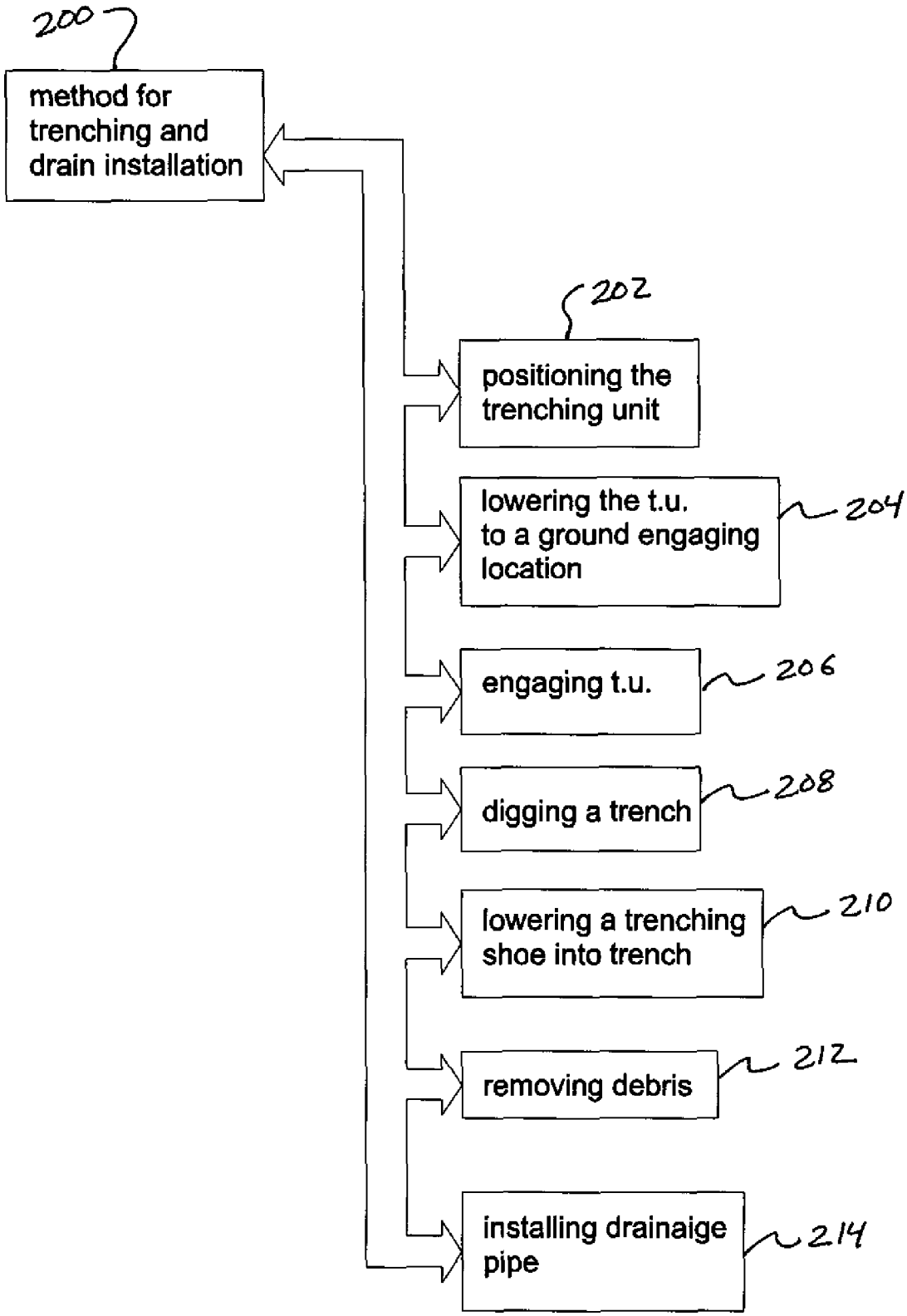
FIG. 10 is a schematic flowchart of the method for trenching and drain installation.

After the trench 114 has been dug as seen in FIG. 8, a drainage pipe must be installed as well as backfill placed above and about the drainage pipe to ensure proper drainage of the trench. A backfill pipe installation system 100 is provided which utilizes the skid steer to drive a backfill hopper 110 while simultaneously laying the corrugated drainage pipe 102 and backfilling the trench 114 with backfill material 112. During this installation of the corrugated drainage pipe 102, the backfill material envelops the corrugated drainage pipe and places the drainage pipe in, at least in one embodiment, within a sand envelope where the drainage pipe is positioned approximately 2" above the bottom floor of the trench, and in other embodiments, approximately ½" above the bottom grade of the trench. A discussion of the construction of the hopper 110 will now be provided as seen FIGS. 8 and 9.

The backfill hopper 110 is constructed to support the pipe carriage 104 which carries the corrugated drainage pipe 102. The pipe carriage stays 108, are arranged vertically to support the cantilevering of the pipe carriage 104 enabling it to rotate about the cantilevered arm 103. The purpose is to enable the corrugated drainage pipe 102 to be continuously fed through a guide sleeve 116 which travels along the trench 114 and has a horizontal exit sleeve 119 enabling the corrugated drainage pipe 102 to be continuously fed at a constant riser height 117 which meets the elevational requirements of the corrugated drainage pipe 102 for proper drainage of the trench. During the placement of the corrugated drainage pipe 102, the trench is continuously filled with backfill 112 which creates a soil envelope about the corrugated drainage pipe while encasing the pipe at the constant riser height 117 position. The continuous riser height elevation parallels the bottom grade of the trench 114. The guide sleeve 116 is maintained in a central position within the trench 114 through the use of a trench guide 118 which is positioned along the central line profile of the trench and provides for consistent steering along the trench while the skid steer 14 drives the hopper 110 from the aft end.

To ensure that the corrugated drainage pipe 102 will be placed at the constant riser height 117 parallel with the bottom grade of the trench 114, the hopper 110 and the guide sleeve 116 are each allowed to adjust vertically with the change of the above grade line elevation 115 through the use of a riser grade adjustment 122 attached to the hopper fore end wall 130 and the guide sleeve 116, and a hopper grade adjustment 124 which is attached to the front loader plate 19 and the hopper aft end wall 132. The hopper grade adjustment 124 enables the aft end of the hopper to avoid vertical movements from the skid steer 14 but to still receive the horizontal force to drive the hopper along the path of the trench. The hopper grade adjustment 124 has a front loader hinge 136 and a hopper hinge 138 spanned by a rigid connecting member to provide for the transfer of compressive forces from the skid steer to the hopper.

The riser grade adjustment 122 has a fore end hopper hinge 140 which is pivotably connected to riser grade adjustment bars which are pivotably connected to sleeve hinges 142 mounted on the side wall of the guide sleeve 116. Furthermore, the guide sleeve 116 travels through the trench guide 118 while the trench guide 118 is rigidly connected to the hopper fore end wall 130. The backfill soil must be provided into the inner region of the hopper 110 and must continuously fall through the backfill sleeve 126 which is arranged along the full longitudinal length of the backfill hopper. The backfill sleeve 126 is approximately the same width as the trench 114 which provides for consistent filling of the trench. The hopper has angled sidewalls 134 which each taper to the narrow backfill sleeve width 126. There is a full opening with an absence of a top wall providing a top wall edge 113 which makes the top edges of the fore and aft end walls and the two angled sidewalls. A soils baffle 111 provides for additional retention of the soil as it is thrown into the hopper 110.

The backfill hopper travels on plurality of four wheels 144 which are each individually connected to the sidewalls 134 through the use of axle boxes 144 which provide for the proper alignment and cantilevering of the wheel axles 150 to support the wheels 144. The reasoning for a non-continuous axle to support two wheels is because the backfill sleeve 126 requires a continuous travel along the entire longitudinal length of the hopper.

Figure 5:
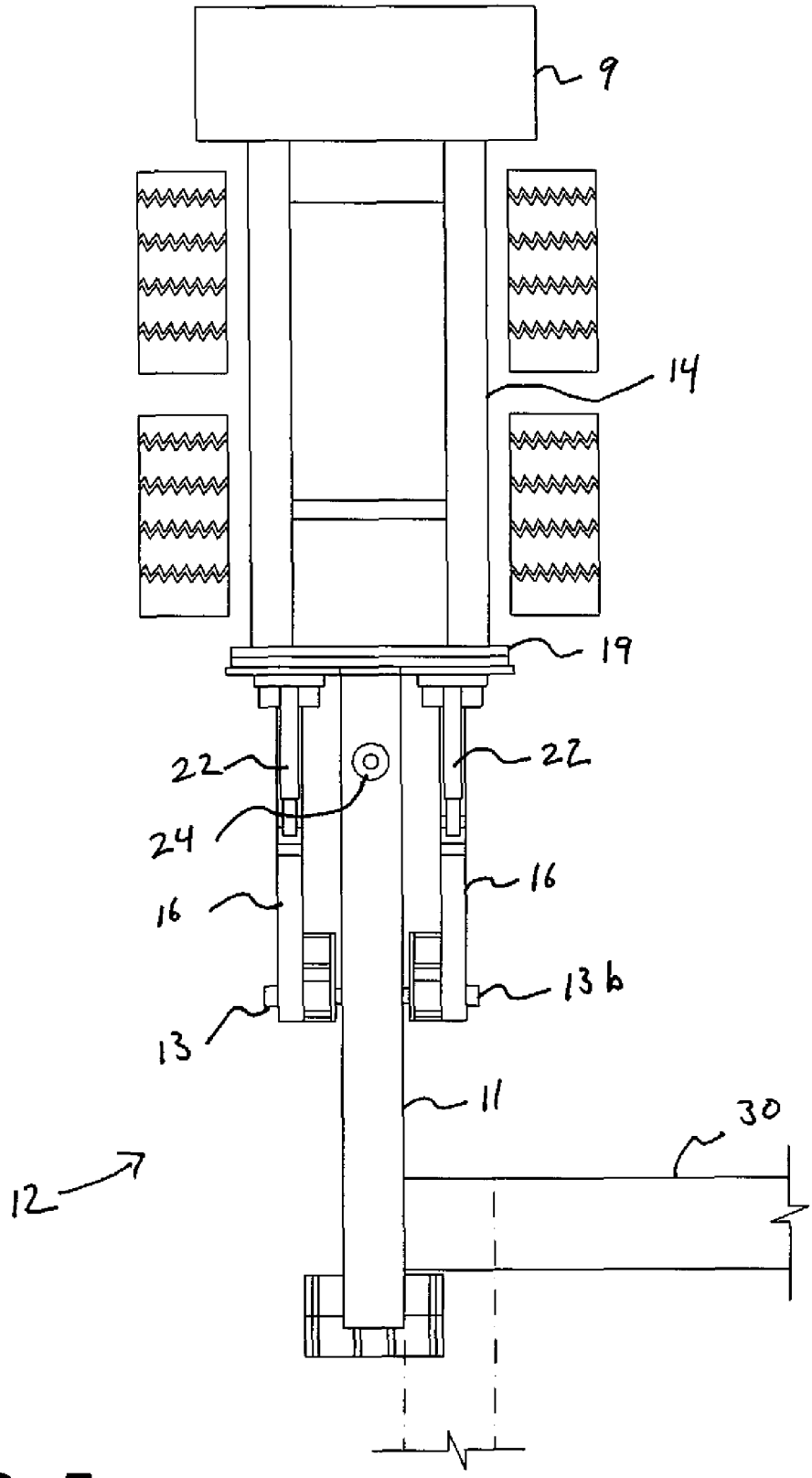
FIG. 5 is a top plan view of the trenching assembly.

A detailed discussion of the method for trenching and drain installation will now be provided. Referring now to FIG. 5, the method includes first positioning the trenching unit at step 202 along the trench profile. In other words, the trenching unit will be placed along the centerline or trenching profile by utilizing the skid steer which is attached to the trenching unit through the use of the skid steer front loader plate.

The operator of the trenching unit will lower the trenching unit to a ground engaging location at step 204 and the operator will first engage a trenching hood controller which is located in the operating portion of the skid steer, and move the trenching unit by utilizing the hydraulic power source operated under the hydraulic controller, to actuate the trenching hood controller and move the skid steer front loader plate onto the ground engaging location and in-line with the trenching profile.

The operator will then engage the trenching unit has seen in step 206, by actuating a blade controller which is located on the hydraulic controller of the trenching unit. Thus hydraulic pressure is applied to the hydraulic motor which is attached to the articulating member and the trenching blade. The trenching blade begins to rotate about the centrally aligned axle or axis in preparation of digging the trench.

The operator will then begin to dig the trench at step 208 along the trenching profile. In order to do this, the user must actuate the articulating member controller, located on the hydraulic controls, which then actuates the articulating member about a hinge or pivot point which is located on or near the front loader plate. This is accomplished by asserting hydraulic pressure onto the articulating member through the use of the articulating member hydraulic 22 as seen in FIGS. 5, 1 and 2, which lowers the trenching blade towards the ground engaging location where the trench is to be dug. The tools which are rotating about the outside circumference of the trenching blade begin to dig into the ground engaging location along the trenching profile to create the trench. The trench will have the profile width and depth decided by the operator who monitors the depth of the trench by using the depth gauge 25 seen in FIG. 2, and the digging width 158 as seen in FIG. 6.

Once the digging has begun, the operator can lower a trenching shoe into the trench at step 210. This step requires the operator to actuate the trench shoe controller, which then asserts a hydraulic pressure onto the trenching shoe through the use of the trench shoe hydraulic 24 seen in FIG. 2. Thus releasing the pressure and lowering the trenching shoe into the trench.

As the trenching is occurring, the operator can also remove the debris at step 212 when the debris is pushed into the debris collection location by the trenching blade (this generally happens automatically with the rotation of the trenching blade forcing the soil into the collection location.) The soil is removed from the collection location by utilizing the spoils conveyor. The spoils conveyor has a hydraulically driven conveyor belt which utilizes a never-ending series of spoils shelves, which scoop out or lift out the debris or spoils from the debris collection location and away from the trenching unit. The spoils are then deposited as previously discussed, onto a spoils hopper for removal from the site or reinstallation back into the trench after the pipe is laid.

Lastly, the operator can attach the skid steer to the backfill hopper 110 as seen in FIG. 8, and install the drainage pipe at step 214. This includes positioning the backfill hopper above the trench and installing the corrugated pipe into the trench at the predefined riser height. In order to install the corrugated pipe at the trench, the corrugated piping is fed from a rotating pipe feed through the guide sleeve and installed into the trench at the riser height. The backfill which in some embodiments may be a sand material is deposited in to the backfill hopper 110 from the backfill truck 106. As the backfill hopper fills with the backfill, the backfill soil or sand is distributed into the trench through the backfill sleeve 126 and installed about the corrugated pipe filling the trench to the ground level, all the while maintaining the corrugated pipe at the riser height thus completing the installation.

Therefore we claim:

1. A trencher system comprising:

a. a front loader comprising a front loader plate, a hydraulic power source and hydraulic control system;

b. said front loader plate configured to slidably receive an implement driven trencher assembly, said implement driven trencher assembly comprising: a circular trenching blade configured to produce a rectilinear trench comprising a profile width and a profile depth;

c. said circular trenching blade mounted on a drive axle, said drive axle supported by a first arm and a second arm;

d. said first arm and said second arm each pivotably connected to a front loader attachment plate, said front loader attachment plate configured to slidably attach to said front loader plate;

e. said hydraulic power source and hydraulic control system interoperating with a first hydraulic arm pivotably attached to said front loader attachment plate and said first arm, said first hydraulic arm configured to lift and release said first arm to engage and disengage said implement driven trencher assembly from a ground engaging location.

2. The system according to claim 1 wherein said system further comprises: a second hydraulic arm pivotably attached to said front loader attachment plate and to a second arm, said second hydraulic arm configured to interoperate with said hydraulic power source and hydraulic control system to lift and release said second arm to engage and disengage with said first arm, said implement-driven trencher assembly from a ground engaging location.

3. The system according to claim 2 wherein said implement driven trencher assembly further comprises: a second hydraulic motor to circumferentially drive said trenching blade about said drive axle, said second hydraulic motor operably attached to said second arm.

4. The system according to claim 1 wherein said implement driven trencher assembly further comprises: a hydraulic motor to circumferentially drive said trenching blade about said drive axle.

5. The system according to claim 4 wherein said hydraulic motor further comprises: a planetary gearbox comprising a five to one ratio reduction.

6. The system according to claim 1 wherein said circular trenching blade further comprises: a blade diameter; an outer circumferential edge; a blade width; a plurality of trenching tools equidistantly interspersed about said outer circumferential edge to provide for digging into said ground engaging location.

7. The system according to claim 6 wherein said circular trenching blade further comprises: said blade diameter ranging from approximately at least 24" in diameter to approximately at most 90" in diameter.

8. The system according to claim 7 wherein said circular trenching blade further comprises: a load bearing weight ranging from approximately at least 250pounds to approximately at most 4,750 pounds.

9. The system according to claim 6 wherein said trenching blade further comprises: a blade width ranging from approximately at least 1½" to approximately at most 6".

10. The system according to claim 6 wherein said trenching blade further comprises: said plurality of the trenching tools equidistantly interspersed at approximately at least 6" to approximately at most 24".

11. The system according to claim 6 wherein said plurality of trenching tools further comprises: each trenching tool comprising a cylindrical main tool body comprising a larger outer diameter, a conically shaped tool head comprising a cylindrical tool head main body, said cylindrical tool head main body comprising a smaller diameter than said tool body's larger diameter, a tool base comprising a rigid attachment to said tool body.

12. The system according to claim 1 wherein said trencher assembly further comprises: a trencher hood, said trencher hood configured to encase said trenching blade to maintain control of excess earthen debris during a trenching operation.

13. The system according to claim 12 wherein said assembly further comprises: a trenching shoe configured to follow said trenching blade and clean said rectilinear trench during said trenching operation.

14. The system according to claim 13 wherein said trenching shoe further comprises: a semicircular arm interoperably engaged with a shoe hydraulic for expansion and contraction of said trenching shoe into said rectilinear trench during said trenching operation.

15. The system according to claim 12 wherein said trencher assembly further comprises: a radial blade sleeve configured within said trenching hood enabling said trenching hood to be placed on said ground engaging location, and said trenching blade to remain in a non-ground engaging location, providing a three-step trenching process.

16. The system according to claim 15 wherein said three-step trenching process further comprises:

a. engaging said hydraulic power and control system to lower said implement driven trencher assembly to a ground engaging location;
b. rotating said trenching blade about said radial axis;
c. digging said rectilinear trench by operating said hydraulic power and control system to engage said trenching blade with said ground engaging location and digging said rectilinear trench to a predefined trench width and trench depth.

17. The system according to claim 16 wherein said trencher assembly further comprises: a spoils remover configured to receive dirt and debris during the trenching process and place said dirt and debris into a debris container.

18. The system according claim 17 wherein said spoils remover further comprises: a debris reception location where are said dirt and debris collects during said trenching process, a conveyor configured to lift said dirt and debris out of said debris reception location and deposit said dirt and debris into said debris container.

19. The system according claim 17 wherein said spoils remover further comprises: a transverse arrangement perpendicular to said trenching blade.

20. The system according to claim 17 where said spoils remover further comprises: a longitudinal arrangement parallel with said trenching blade.

21. A method for trench and drain installation, said method comprising:

positioning a trenching unit along a trenching profile utilizing a skid steer, said skid steer having a front loader plate, wherein said skid steer is attached to said trenching unit at said front loader plate;
lowering a trenching unit onto a ground engaging location arranged along said trenching profile;
engaging said trenching unit;
digging a trench along said trenching profile;
lowering a trenching shoe into said trench during digging to remove excess debris:
removing debris from said trench during said the trenching along said trenching profile;
installing a drainage pipe above a trenching floor in a backfill envelope;
wherein said lowering a trenching unit further comprises:
engaging a trenching hood controller from a hydraulic controller, said hydraulic controller comprising said trenching hood controller, trench shoe controller, an articulating member controller, and a blade controller;
moving said trenching unit comprising a trenching hood, an articulating member interacting with a trench blade, and a debris removal conveyor, and a trenching shoe;
moving said trenching unit by utilizing a hydraulic power source operated by said hydraulic controller, said trenching unit comprising a trenching hood, an articulating member interacting with a trench blade, a debris removal conveyor, and a trenching shoe;
actuating said trenching hood controller to move said skid steer front loader plate and lower said trenching hood onto said ground engaging location in line with said trenching profile.

22. The method according to claim 21 wherein said engaging said trenching unit further comprises: rotating said trench blade by:

a. actuating said blade controller;
b. applying hydraulic pressure to a hydraulic motor attached to said articulating member and said trench blade;
c. rotating said trench blade about a centrally aligned blade axis.

23. The method according to claim 22 wherein said digging a trench along said trenching profile further comprises:

a. actuating said articulating member controller;
b. actuating said articulating member about a pivot point located near said front loader plate by:
   i. asserting hydraulic pressure onto said articulating member to engage said trench blade with said ground engaging location;
c. digging into said ground engaging location along said trenching profile to create a trench having a profile width and a profile depth.

24. The method according to claim 23 wherein said lowering a trenching shoe further comprises:

a. actuating said trench shoe controller;

b. asserting hydraulic pressure onto said trenching shoe to lower said trenching shoe into said trench.

25. The method according to claim 24 wherein said removing debris from said trench further comprises:

a. pushing said debris into a debris collection location utilizing said trench blade;

b. removing said debris from said debris collection location by:

i. utilizing a spoils conveyor said spoils conveyor comprising a hydraulically driven conveyor belt comprising a never ending series of spoils shelves ii. lifting said spoils out of said debris collection location and away from said trenching unit.

26. The method according to claim 25 wherein said installing a drainage pipe further comprises:

a. positioning a backfill hopper above said trench, said backfill hopper comprising a backfill sleeve comprising a width substantially the same as said profile width, a constant riser for placement of a pipe a riser height above the floor of said trench, a trench guide to steer said backfill hopper along said trench, a rotating pipe feed supporting a corrugated drainage pipe for installation into said trench through a guide sleeve depositing said corrugated drainage pipe at the riser height;

b. installing said corrugated pipe into said trench at said riser height;

c. installing said backfill about said corrugated pipe and filling said trench to ground level.

27. A system for trench and drain installation said system comprising:

an implement driven trencher assembly and a backfill pipe installation assembly;

said implement driven trencher assembly configured to produce a rectilinear trench comprising a profile width and a profile depth utilizing a circular trenching blade operably mounted on a front loader;

said backfill pipe installation assembly configured to install a drainage pipe into said trench at a riser height above a trench floor and, simultaneously envelop said drainage pipe with backfill material to maintain said drainage pipe at said riser height;

wherein said implement driven assembly further comprises a front loader attachment plate to slidably interconnect with said front loader at a front loader plate; said circular trenching blade mounted on a drive axle, said drive axle supported by a first arm and a second arm;

wherein said implement driven trencher further comprises: a hydraulic power source and a hydraulic control system interoperating with a first hydraulic arm pivotably attached to said front loader attachment plate and said first arm, to lift and release said first arm in order to engage and disengage said implement driven trencher assembly from a ground engaging location.

28. The system according to claim 27 wherein said backfill pipe installation assembly further comprises: a backfill hopper configured to install said drainage pipe into said trench, and simultaneously install said backfill material about said drainage pipe in said trench.

29. The system according to claim 28 wherein said backfill hopper further comprises: a backfill sleeve comprising a width substantially the same as said profile width, a drainage pipe carrier for maintaining a reserve of drainage pipe for installation along said trench, a trench guide rigidly attached to said backfill hopper to guide said backfill pipe installation assembly along said trench.

30. The system according to claim 29 wherein said backfill pipe installation assembly further comprises: a drainage pipe installation guide sleeve operably configured to travel at a constant riser height elevation above said trench floor and maintain an adjustable vertical alignment with said backfill hopper, said backfill hopper riding on a varying grade elevation.

31. The system according to claim 30 wherein said trench pipe installation guide sleeve further comprises: a riser grade adjustment mechanism configured to maintain said guide sleeve in a longitudinal and transverse position in line with said trench, while allowing said guide sleeve to adjust vertically along with said backfill hopper riding on said varying grade elevation.

32. The system according to claim 31 wherein said backfill pipe installation assembly further comprises a second front loader configured to drive said backfill hopper along said trench.

33. The system according to claim 32 wherein said backfill hopper further comprises: a hopper grade adjustment mechanism configured to maintain said backfill hopper along a longitudinal and transverse position in line with said trench, while allowing said backfill hopper to adjust vertically along with said second front loader riding on said varying grade elevation.

* * * * *